US005967758A

United States Patent [19]

Fujii et al.

[11] Patent Number: 5,967,758

[45] Date of Patent: Oct. 19, 1999

[54] CONTROLLING DEVICE FOR CONTROLLING ROTATIONAL SPEED OF ENGINE OF HYDRAULIC WORKING MACHINE

[75] Inventors: Kazuhiko Fujii; Hideki Kinugawa; Hiroshi Togo, all of Hiroshima, Japan

[73] Assignee: Kabushiki Kaisha Kobe Seiko Sho, Kobe, Japan

[21] Appl. No.: 08/836,471

[22] PCT Filed: Sep. 13, 1996

[86] PCT No.: PCT/JP96/02636

§ 371 Date: Jul. 21, 1997

§ 102(e) Date: Jul. 21, 1997

[87] PCT Pub. No.: WO97/11265

PCT Pub. Date: Mar. 27, 1997

[30] Foreign Application Priority Data

Sep. 18, 1995 [JP] Japan ..... 7-238516

[51] Int. Cl.[6] ..... F04B 49/02

[52] U.S. Cl. ..... 417/34; 417/12

[58] Field of Search ..... 417/12, 34, 25, 417/42, 44.1; 212/162; 123/357

[56] References Cited

U.S. PATENT DOCUMENTS

| | | | |
|---|---|---|---|
| 4,371,051 | 2/1983 | Achterholt | 180/271 |
| 4,549,400 | 10/1985 | King | 60/394 |
| 4,643,146 | 2/1987 | Spriessler | 123/357 |
| 4,792,052 | 12/1988 | Okuda et al. | 212/162 |
| 5,317,871 | 6/1994 | Ito et al. | 60/452 |

FOREIGN PATENT DOCUMENTS

| | | |
|---|---|---|
| 56-141402 | 5/1981 | Japan . |
| 60-38561 | 9/1985 | Japan . |

*Primary Examiner*—Timothy S. Thorpe
*Assistant Examiner*—Robert Z. Evora
*Attorney, Agent, or Firm*—Oblon, Spivak, McClelland, Maier & Neustadt, P.C.

[57] ABSTRACT

A controlling device ensures an accurate control of the rotational speed of an engine. When a hydraulic working machine is in a suspended state, the rotational speed of the engine can be changed from a designated rotational speed to a low rotational speed without requiring any specific manipulation by the operator. When all control levers 14 to 21 are shifted to their respective neutral positions to suspend the operation, and the shifting speed of the control lever which is lastly shifted to its neutral position is low, a delay time is set to be longer than in the case of high shifting speed. If the control levers 14 to 21 are maintained in their respective neutral positions after the elapse of the delay time, the engine 1 is changed to the low rotational speed mode. When one of control levers is shifted before the elapse of the delay time, the engine 1 is continuously maintained in the designated rotational speed mode.

6 Claims, 5 Drawing Sheets

CONTROLLING DEVICE FOR CONTROLLING ROTATIONAL SPEED OF ENGINE OF HYDRAULIC WORKING MACHINE

BACKGROUND OF THE INVENTION

1. Field of the Invention

The present invention relates to a controlling device for controlling the rotational speed of an engine of a hydraulic working machine for use in civil and construction engineering, such as crane, hydraulic excavator.

2. Discussion of the Related Art

A hydraulic working machine of this type includes a hydraulic pump driven by an engine, a plurality of actuators such as hydraulic cylinders and hydraulic motors operated by oil supplied from the hydraulic pumps under pressure, and a plurality of control levers for controlling the plurality of actuators, respectively. The hydraulic pump feeds oil to each actuator under pressure via a directional change valve driven by a control lever to actuate the actuator to perform working operation. In general, the hydraulic working machine is provided with a throttle lever for setting a rotational speed of the engine to enable the operator to properly change the amount of oil fed from the hydraulic pump in accordance with operation modes.

Japanese Patent Publication No.60-38561 discloses a device for suppressing the fuel consumption for engine during the suspension period of working operation of a hydraulic working machine. This device includes a switch to enable the operator to selectively control the engine to run either at a predetermined low rotational speed for reducing the fuel consumption or at a speed designated by the throttle lever. When all the control levers are shifted to their respective neutral positions in the state that the low rotational speed mode is selected by the switch, the engine is controlled to run at the low rotational speed.

Further, the device of the above publication does not permit the engine to run at the low rotational speed as far as a predetermined time does not elapse after all the control levers are shifted to their respective neutral positions to prevent an undesirable performance that the engine is unintentionally controlled to run at the low rotational speed immediately after all the control levers are shifted to their respective neutral positions in the state that the low rotational speed mode is selected by the switch.

However, the device of the above publication has the inconvenience that to control the engine to run at the low rotational speed in the operation suspension period, the operator is required to manipulate the switch. In addition, if the operator forgets to manipulate the switch when suspending the operation, the engine continues to run at a high rotational speed designated by the throttle lever. This causes unnecessary consumption of fuel.

Furthermore, the device of the above publication immediately restores the rotational speed of the engine to a speed designated by the throttle lever when at least one of the control levers is shifted from its neutral position to its working position in the state that the engine is controlled to run at the low rotational speed. For this reason, there is a likelihood that if a high rotation speed is designated by the throttle lever, even a small shift of a control lever causes rapid increase in the rotational speed of the engine, and results in rapid increase in the amount of oil fed from the hydraulic pump and a sudden change in the actuating speed of the actuator against the operator's intention.

SUMMARY OF THE INVENTION

The present invention has been worked out to solve the above-described problems, and has an object to provide a controlling device for controlling the rotational speed of an engine of a hydraulic working machine which makes it possible to assuredly change the rotational speed of the engine from a rotational speed designated by a throttle lever to a low rotational speed without special manipulation such as manipulating a switch when suspending the working operation, and to prevent the problem that the engine is unintentionally changed to the low rotational speed during the working operation.

It is another object of the present invention to provide a controlling device for controlling the rotational speed of an engine of a hydraulic working machine which makes it possible to smoothly restore the rotational speed of an engine from a low rotational speed to a speed designated by a throttle lever in response to operator's intention when restarting the working operation from the state that the engine is controlled to run at the low rotational speed.

To solve the above-described problems, the present invention has the following constructions.

Specifically, the present invention is directed to a controlling device for controlling the rotational speed of an engine of a hydraulic working machine provided with: a hydraulic pump driven by an engine; a plurality of actuators operated by oil supplied under pressure from the hydraulic pump; a plurality of actuator operating members for operating the plurality of actuators respectively; and rotational speed designating means for designating a rotational speed of the engine, the controlling device includes:

delay time setting means for setting a delay time in accordance with a shifting speed of at least one of the plurality of actuator operating members to a neutral position thereof when all the actuator operating members are shifted to their respective neutral positions in a state that the engine is at a rotational speed designated by the rotational speed designating means; and rotational speed controlling means for measuring an elapsed time while controlling the engine to run at the designated rotational speed when all the actuator operating members are shifted to their respective neutral positions, and controlling the engine to run at a predetermined low rotational speed to save fuel if the elapsed time reaches the set delay time in a state that all the actuator operating members are maintained in the neutral positions whereas resetting the measurement of elapsed time and controlling the engine to run at the designated rotational speed if at least one of the actuator operating members is shifted from the neutral position to a working position before the elapsed time reaches the delay time, the delay time setting means setting a longer time in a case of low shifting speed that the shifting speed is lower than a predetermined value than in a case of high shifting speed that the shifting speed is higher than the predetermined value.

In the present invention, when the working operation is suspended, all the actuator operating members are shifted to their respective neutral positions and maintained therein. If the predetermined delay time elapses from the time of shifting the actuators to the neutral positions with all the actuator operating members staying in their respective neutral positions, the rotational speed of the engine is changed from the designated rotational speed designated by the rotational speed designating means to the predetermined low rotational speed.

On the other hand, in craning operations and the like, there is a case that all the actuator operating members are held in their respective neutral positions for a relatively long period although the operator has no intention of suspending the working operation. In this case, generally, the shifting speed of at least one of the actuator operating members shifted to their neutral positions (e.g., an actuator operating member which is lastly shifted to its neutral position) is low, that is, the low shifting speed. In this case, the delay time is set to relatively long time. Until the elapsed time reaches this delay time, the rotational speed of the engine is not changed to the low rotational speed but is maintained at the designated rotational speed designated by the rotational speed designating means. Contrary to this, when all the actuator operating members are shifted to their respective neutral positions at relatively high shifting speed, that is, the high shifting speed, the delay time is set to relatively short time. However, during the working operation, even if all the actuator operating members are shifted to their neutral positions, at least one of them is usually returned to its working position in a short time thereafter. There are few cases where all the actuator operating members are maintained in their neutral positions longer than the delay time. Accordingly, even if the delay time is set to a short time, it is possible that during the working operation, the rotational speed of the engine is not changed to the low rotational speed, but is maintained at the rotational speed designated by the rotational speed designating means. When all the actuator operating members are shifted to their respective neutral positions to suspend the working operation, the rotational speed of the engine is changed to the low rotational speed immediately after the short delay time.

It is preferable that the delay time setting means sets a delay time in accordance with a shifting speed of an actuator operating member which is lastly shifted to its neutral position among the plurality of actuator operating members.

It is more preferable that the rotational speed controlling means increases the rotational speed of the engine from the low rotational speed to the designated rotational speed in accordance with an increase in the shifting amount of the actuator operating member when at least one of the actuator operating members is shifted from its neutral position to its maximum working position after the engine is controlled to run at the low rotational speed, and maintains the designated rotational speed after the rotational speed of the engine reaches the designated rotational speed.

In these devices, when at least one of the actuator operating members is shifted from its neutral position to its maximum working position to restart the working operation after the rotational speed of the engine is changed to the low rotational speed, the rotational speed of the engine is increased to the designated rotational speed in accordance with an increase in the shifting amount of the shifted actuator operating member. For example, as an actuator operating member is slowly shifted to its maximum working position, the rotational speed of the engine is slowly increased. Accordingly, a sharp change in the rotational speed of the engine can be avoided. Upon reaching the designated rotational speed, the engine is maintained at the designated rotational speed. Thereafter, the usual working state is accomplished. In other words, when the working operation is restarted in the state that the engine is controlled to run at the low rotational speed in the operation suspension period, the rotational speed of the engine can be smoothly restored to the designated rotational speed in response to the operator's intention.

In this case, it is preferable that the rotational speed controlling means increases the rotational speed of the engine in accordance with an increase in the shifting amount of an actuator operating member which is most greatly shifted among the shifted operating members when a plurality of actuator operating members are shifted from their respective neutral positions to their maximum working position. In this device, the rotational speed of the engine can be increased in accordance with an increase in the shifting amount of an actuator operating member which is most greatly shifted. Therefore, the rotational speed of the engine can be controlled in response to the operator's intention.

Further, it is preferable that when all the actuator operating members are shifted to their neutral positions in the course that the rotational speed is increased in accordance with an increase in the shifting amount of the actuator operating members from their neutral positions to their maximum working positions, the increasing of rotational speed of the engine is stopped and the engine is controlled to run at the present rotational speed.

In other words, the case that all the actuator operating members are returned to their neutral positions in the course of increasing the rotational speed of the engine is usually one that the operator intends to suspend the working operation. Alternatively, even if the operator does not intend, it is no problem for the working operation that the rotational speed of the engine does not reach the designated rotational speed. Therefore, unintended increasing of the rotational speed of the engine can be avoided by stopping the increasing of rotational speed of the engine and maintaining the present rotational speed.

In the case that when all the actuator operating members are returned to their neutral positions in the course of the rotational speed of the engine being increased, the increasing of rotational speed is stopped and the present rotational speed is maintained as mentioned above, furthermore, it is preferable to control the engine to run at the low rotational speed when all the actuator operating members are maintained in the neutral positions until the elapsed time reaches a delay time which is set in accordance with a shifting speed of at least one of the shifted actuator operating members returned to its neutral position, and to increase the rotational speed of the engine to the designated rotational speed in accordance with an increase in the shifting amount of the actuator operating member when at least one of the actuator operating members is shifted from its neutral position to its maximum working position before the elapsed time reaches the delay time.

In other words, the case that all the actuator operating members are returned to their neutral positions and maintained in the neutral positions in the course of increasing the rotational speed of the engine is usually one that the operator intends to suspend the working operation. Accordingly, similarly to the case where the engine is controlled to run at the designated rotational speed, the rotational speed of the engine can be assuredly changed to the low rotational speed by controlling the engine to run at the low rotational speed after the elapsed time reaches the delay time which is set in accordance with the shifting speed of the actuator operating members. On the other hand, when at least one of the actuator operating members is shifted to its maximum working position within the above delay time, the rotational speed of the engine is increased to the designated rotational speed in accordance with an increase in the shifting amount of the shifted actuator operating member, which thereby prevents the engine from being controlled to run at the low rotational speed during the working operation.

DETAILED DESCRIPTION OF THE PREFERRED EMBODIMENTS

An embodiment of the present invention will be described with reference to the drawings.

Figure 1:
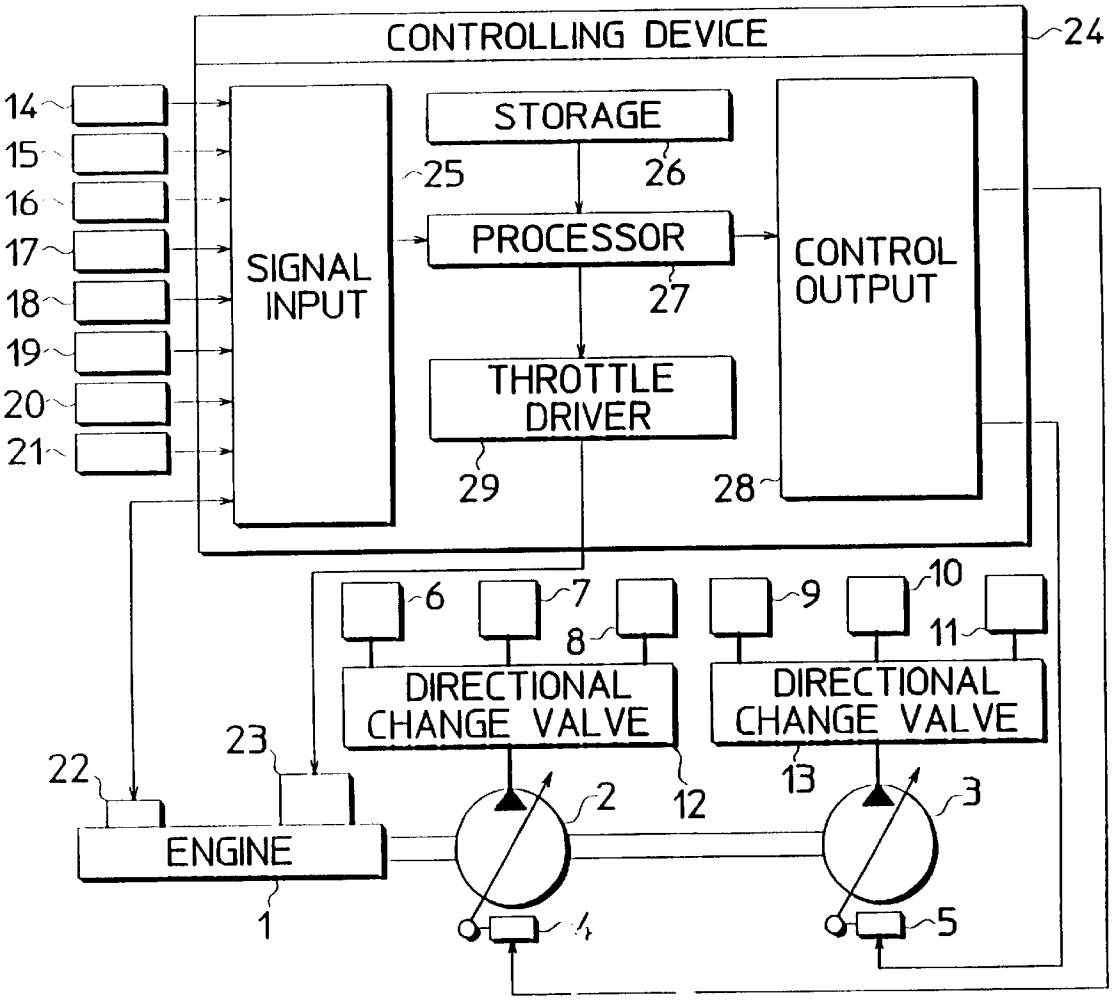
FIG. 1 is a block diagram showing a system construction of a controlling device for controlling the rotational speed of an engine in a hydraulic working machine according to an embodiment of the present invention.

In FIG. 1, indicated at 1 is an engine, indicated at 2 and 3 are a pair of variable displacement hydraulic pumps, indicated at 4 and 5 are regulators for adjusting the capacity of the pumps 2 and 3, indicated at 6 to 11 are respectively an actuator for arm (an oil cylinder 6), an actuator for revolution (an hydraulic motor 7), an actuator for left-side running (a hydraulic motor 8), an actuator for boom (a hydraulic cylinder 9). an actuator for bucket (a hydraulic cylinder 10), and an actuator for right-side running (a hydraulic motor 11).

In this embodiment, the actuators 6 to 11 are categorized in two groups: a group of actuators 6 to 8 driven by the hydraulic pump 2; and a group of actuators 9 to 11 driven by the hydraulic pump 3. In the group of actuators 6 to 8, the capacity of the hydraulic pump 2 is adjusted via a regulator 4 in accordance with instruction from a controlling device 24 to be described later. Also, a directional change valve 12 disposed between the hydraulic pump 2 and the actuators 6 to 8 is operated to supply the oil to the actuators 6 to 8 under pressure from the hydraulic pump 2 to activate the actuators 6 to 8. Similarly, in the group of actuators 9 to 11, the capacity of the hydraulic pump 3 is adjusted via a regulator 5 in accordance with instruction from a controlling device 24. A directional change valve 13 disposed between the hydraulic pump 2 and the actuators 9 to 11 is operated to supply oil to the actuators 9 to 11 under pressure from the hydraulic pump 3 to activate the actuators 9 to 11.

In FIG. 1, each group of actuators is described to be controlled by one directional change valve 12 or 13; however, actually, each of actuators 6 to 8 and 9 to 11 is provided with a directional change valve. The directional change valves are driven by a pilot pressure (an oil pressure) which is applied via unillustrated pilot pipe by moving the control levers provided in correspondence with each of actuators 9 to 11.

In FIG. 1, indicated at 14 to 19 are control levers for boom, arm, bucket, right-side running, left-side running, and revolution, respectively (actuator operating members), indicated at 20 is a mode changing switch for selectively setting operation of the engine 1 in three modes, i.e., a high speed mode for heavy-load operation (hereinafter, referred to as "H mode"), a middle speed mode for a normal operation (hereinafter, referred to as "S mode"), and a low speed mode for a low speed operation (hereinafter, referred to as "FC mode"), indicated at 21 is a throttle lever for adjusting and setting the rotational speed of the engine 1 in an operation mode (engine rotational speed), indicated at 22 is a rotational speed sensor for detecting the rotational speed of the engine 1, indicated at 23 is a throttle motor for driving the throttle of the engine 1, and indicated at 24 is a controlling device including a microcomputer and the like.

Each of the control levers 14 to 19 outputs a signal generated in accordance with their shifting direction and a shifting amount to the controlling device 24 via unillustrated pressure sensor and the like. The mode changing switch 20 outputs a signal generated in accordance with an operation thereof to the controlling device 24. The throttle lever 21 outputs a signal generated in accordance with its shifting amount to the controlling device 24 as a signal for designating the rotational speed for the engine 1. The rotational speed sensor 22 detects a rotational speed of the engine 1 and outputs a signal generated in accordance with the detected rotational speed to the controlling device 24.

The controlling device 24 includes a signal input portion 25 for receiving signals output from the control levers 14 to 19, a storage portion 26 for storing a program and various data, a processor 27 for conducting various predetermined calculations based on the signal data sent to the signal input portion 25 and the data stored in the storage portion 26, a control output portion 28 for controlling the regulators 4 and 5, and a throttle driving portion 29 for driving the throttle motor 23. In this way, these components constitute delay time setting means and rotational speed controlling means of the present invention.

The processor 27 generates a control signal for operating the actuator 6 to 11 in accordance with a shift of the control levers 14 to 19, and then outputs the generated control signal to the control output portion 28. Upon receiving the control signal, the control output portion 28 controls the regulators 4 and 5. Furthermore, the processor 27 generates data on a target rotational speed based on a shift of the control levers 14 to 19, an operation mode of the engine 1 selected by the mode changing switch 20, and a rotational speed of the engine 1 designated by the throttle lever 21. The generated data is then output to the throttle driving portion 29. In accordance with the data, the throttle driving portion 29 drives the throttle motor 23. The control of the engine 1 will be described later.

In the embodiment of the present invention, the directional change valves 12 and 13 are controlled by hydraulic pressure. However, they may be electrically controlled, for example, by a control signal output from the control output portion 28 of the controlling device 24.

Next, the control of rotational speed of the engine 1 by the controlling device 24 will be described referring to FIGS. 2 to 8.

Figure 2:
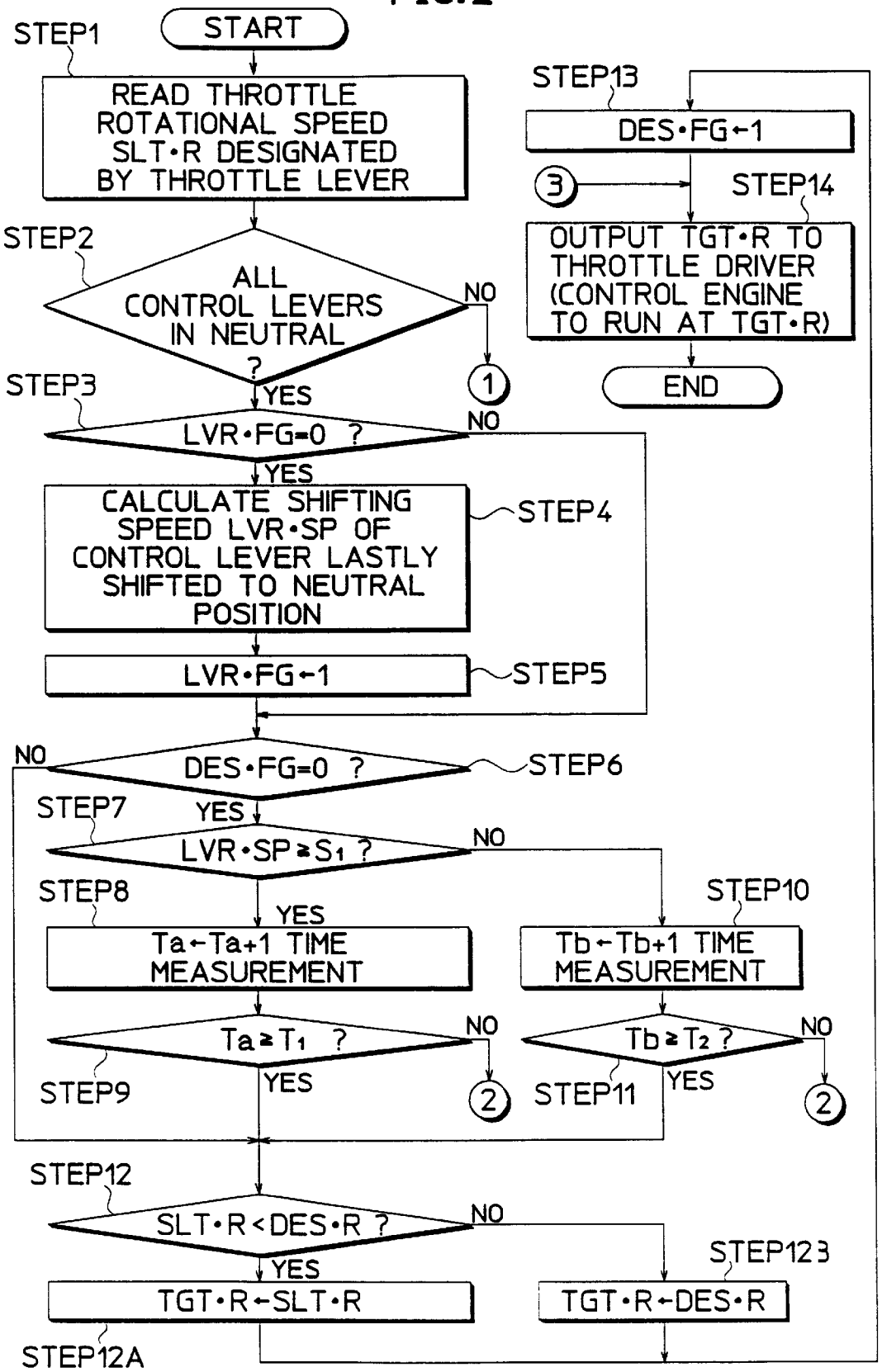
FIG. 2 is a flowchart showing a part of a control operation of the controlling device.
Figure 3:
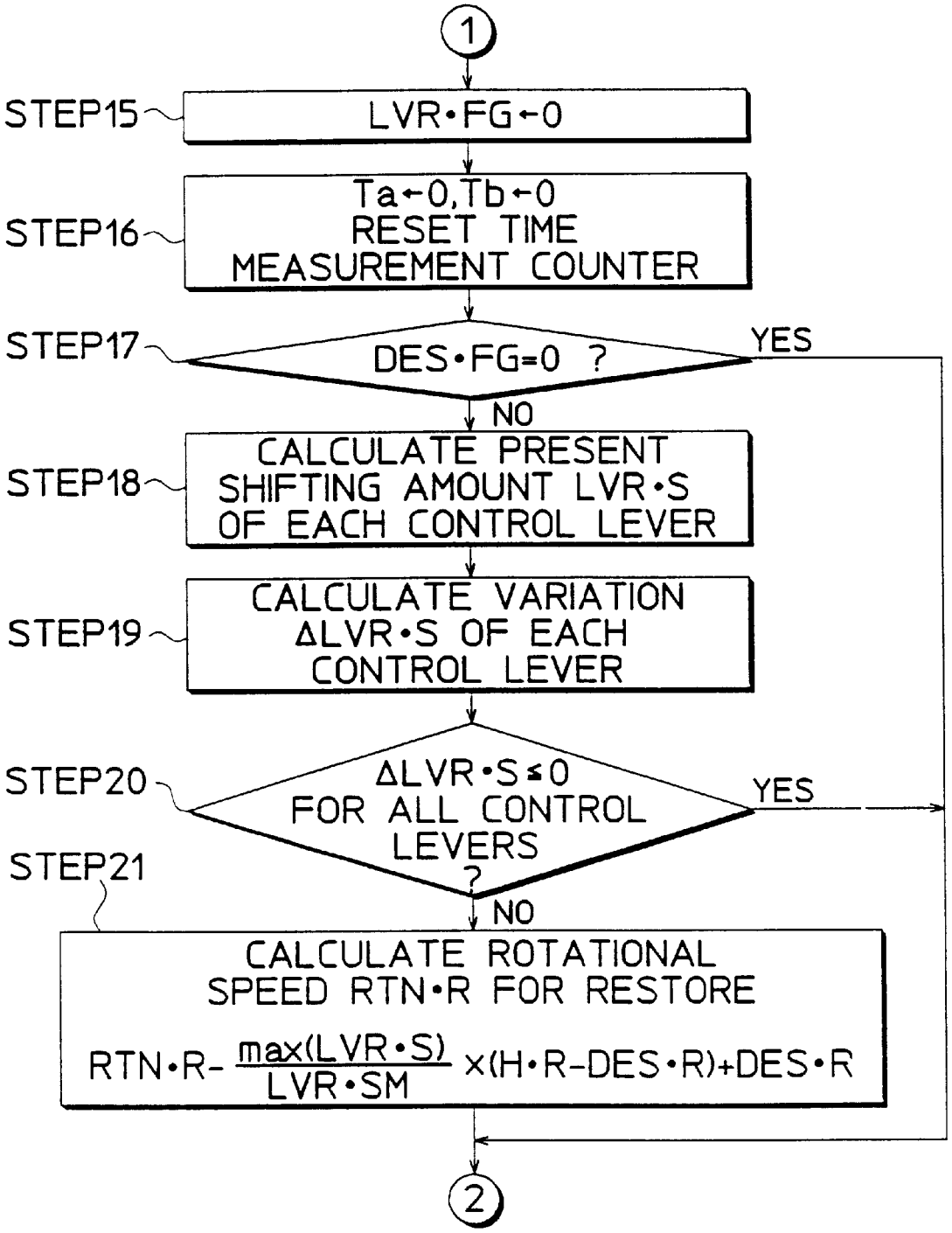
FIG. 3 is a flowchart showing another part of the control operation of the controlling device.
Figure 4:
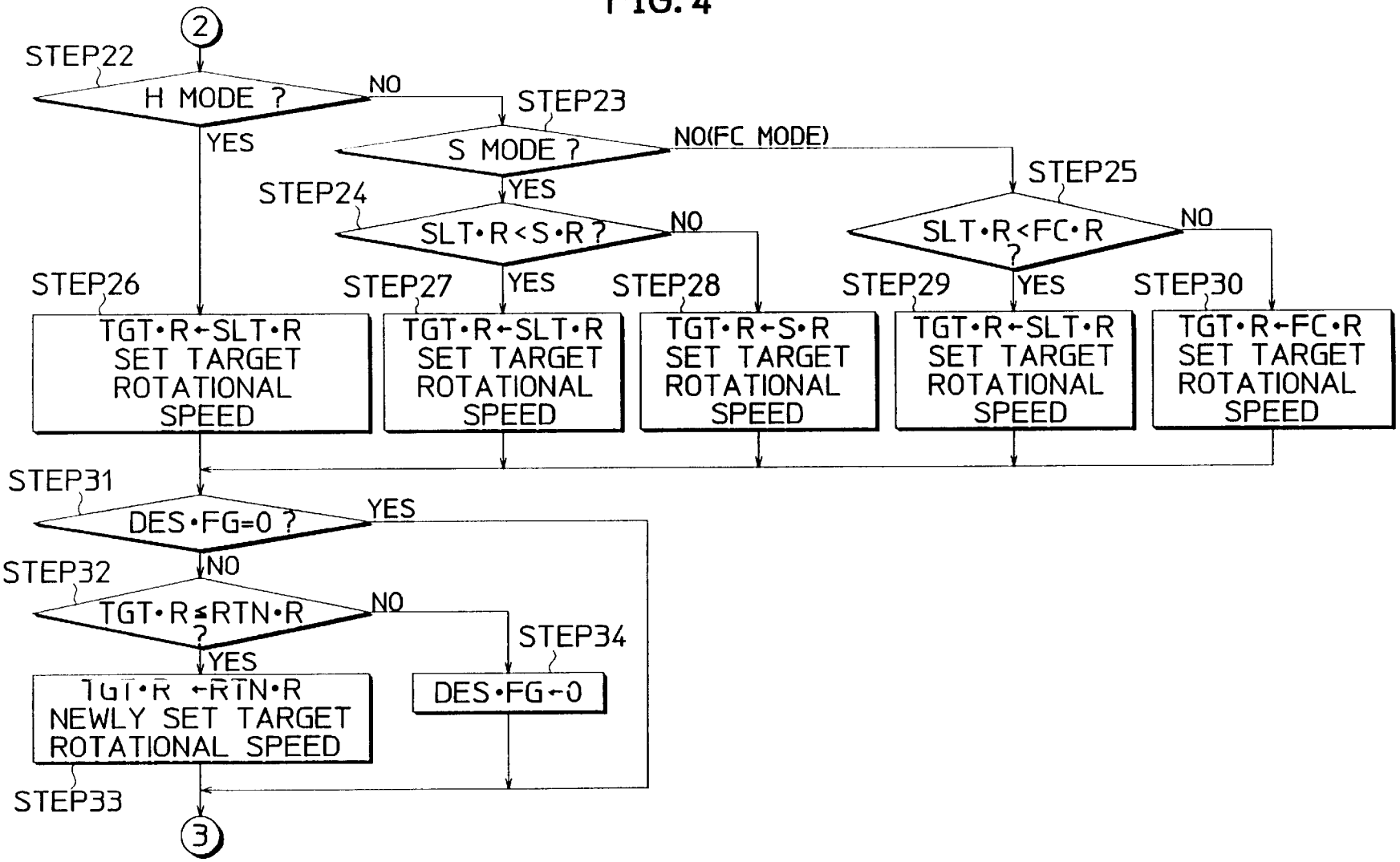
FIG. 4 is a flowchart showing another part of the control operation of the controlling device.

In the embodiment of the present invention, the controlling device 24 conducts procedures shown by flowcharts in FIGS. 2 to 4 in each predetermined cycle time. First, there will be described operation of a case that for the operator to suspend the working operation when the hydraulic working machine is in the normal operation, all the control levers 14 to 19 are shifted to their respective neutral positions and maintained therein.

In each cycle time, the processor 27 of the controlling device 24 reads a designated rotational speed SLT·R of the engine 1 designated by the throttle lever 21 (STEP 1) based on the signal sent from the throttle lever 21 to the signal input portion 25. Then, the processor 27 judges whether or not all the control levers 14 to 19 are in their respective neutral positions based on the signals sent from each of the control levers 14 to 19 to the signal input portion 25 (STEP 2).

As described above, when all the control levers 14 to 19 are in their respective neutral positions, the processor 27 judges whether or not the value of flag LVR·FG is "0" (STEP 3). In the cycle time when all the control levers 14 to 19 are shifted to their respective neutral positions, the value of the flag LVR·FG is set to "1" via STEP 5 which will be described later. The value in the normal operation or the initial value of the flag LVR·FG is "0". Accordingly, the value of the flag LVR·FG at this time is "0" (YES in STEP 3). The processor 27 calculates a shifting speed LVR·SP of the control lever which is lastly shifted to its neutral position among the control levers 14 to 19 (STEP 4).

The storage portion 26 stores data on the shifting amounts of each of control levers 14 to 19 in time sequence in the order from the present to the past. The shifting amounts are obtained based on the signals sent from each of control levers 14 to 19 in each cycle time. Based on the stored data, the processor 27 recognizes which control lever is lastly shifted to its neutral position. Then, the processor 27 obtains a shifting speed LVR·SP of the last control lever based on the above-mentioned shifting amount data in the time sequence (more specifically, an average value of shifting speeds in a plurality of cycle times until the control lever reaching the neutral position).

The shifting speed LVR·SP may be an average value of shifting speeds of shifted control levers among the control levers 14 to 19.

Upon obtaining the shifting speed LVR·SP, the processor 27 sets the value of the flag VLR·FG to "1" (STEP 5). As far as the control levers 14 to 19 are maintained in their respective neutral positions in the next cycle time and afterward, that is, as far as the result of judgment in STEP 2 is "YES", the value of the flag LVR·FG is kept at "1". Accordingly, the result of judgment in STEP 3 becomes "NO" in the next cycle time and afterward. In this case, the procedures in STEPs 4 and 5 are omitted and the following procedures are performed.

After setting the value of the flag LVR·FG to "1", the processor 27 judges whether or not the value of flag DES·FG is "0" or not (STEP 6). The flag DES·FG is used to judge whether or not the engine 1 is controlled to run at a predetermined low rotational speed (e.g., at a speed of 1050 rpm or less, hereinafter, this low rotational speed is referred to as "DECEL rotational speed") to reduce the fuel consumption when the working operation is suspended. The value of the normal operation or the initial value is "0". When the engine 1 is controlled to run at the DECEL rotational speed, the flag DES·FG is set to "1" via STEP 13 which will be described later. In this case, the value of the flag DES·FG is "0", and the processor 27 judges whether or not the shifting speed LVR·SP obtained in STEP 4 is greater than the predetermined speed $S_1$ (STEP 7).

In this state, when the operator shifts all the control levers 14 to 19 to their respective neutral positions to suspend the operation, the shifting speed of the control levers 14 to 19 to the neutral positions is relatively high. In this case, the shifting speed LVR·SP is equal to or higher than the predetermined speed $S_1$ (LVR·SP≧$S_1$:YES in STEP 7), and the processor 27 increases the value of the first counter Ta for time measurement by "1" (STEP 8). The value of the first counter Ta is increased by "1" in STEP 8 in each cycle time as far as all the control levers 14 to 19 are maintained in their respective neutral positions in the next cycle time and afterward. Accordingly, the value of the first counter Ta is an indicator of the elapsed time from the point where all the control levers 14 to 19 are shifted to their respective neutral positions. In the case where the shifting speed LVR·SP is lower than the predetermined speed $S_1$ (LVR·SP<$S_1$: NO in STEP 7),the time is measured by the same manner as that conducted in the case where the shifting speed LVR·SP is equal to or higher than $S_1$ (LVR·SP≧$S_1$), which will be described later.

After increasing the value of the first counter Ta as described above, the processor 27 judges whether or not the value of the first counter Ta is equal to or larger than the predetermined first delay time T1 (STEP 9). The first delay time T1 is a delay time for the high shifting speed which is determined in correspondence to the case of LVR·SP≧$S_1$ in STEP 7, that is, in the case where the shifting speed of the control lever lastly set to its neutral position among the control levers 14 to 19 is the high shifting speed equal to or higher than the predetermined speed $S_1$.

The first delay time T1 is set in a relatively short time (e.g., 4 seconds). However, immediately after all the control levers 14 to 19 are shifted to their respective neutral positions, the value of the first counter Ta is smaller than the value of the first delay time T1 (Ta<T1: NO in STEP 9). In this case, the processor 27 conducts procedures shown by the flowchart in FIG. 4. More specifically, the processor 27 sets a target rotational speed TGT·R of the engine 1 by the following steps in accordance with an operation mode selected by the mode changing switch 20.

A) In the case where the operation mode selected by the mode changing switch 20 is H mode for heavy-load operation (YES in STEP 22): The target rotational speed TGT·R is set to the present rotational speed SLT·R designated by the throttle lever 21 (STEP 26).

B) In the case where the operation mode is S mode for the normal operation (YES in STEP 23) and the designated rotational speed SLT·R is smaller than the upper limit rotational speed S·R which is determined in advance for the S mode (e.g., 2250 rpm, hereinafter, referred to as "upper limit rotational speed S·R for normal operation") (YES in STEP 24): The target rotational speed TGT·R is set to the present designated rotational speed SLT·R (STEP 27).

C) In the case where the operation mode is the S mode (YES in STEP 23) and the designated rotational speed SLT·R is equal to or larger than S·R (SLT·R≧S·R: NO in STEP 24): The target rotational speed TGT·R is set to the upper limit rotational speed for normal operation S·R (STEP 28).

D) In the case where the operation mode is the FC mode for low speed operation (NO in STEP 23) and the designated rotational speed SLT·R is smaller than the upper limit rotational speed FC·R which is determined in advance for the S mode (e.g., 1800 rpm, hereinafter, referred to as "upper limit rotational speed for low speed operation FCR") (YES in STEP 25): The target rotational speed TGT·R is set to the present designated rotational speed SLT·R (STEP 29).

E) In the case where the operation mode is the FC mode for low speed operation (NO in STEP 23) and the designated rotational speed SLT·R is equal to or larger than the upper limit rotational speed for low speed operation FC·R (SLT·R≧FC·R: NO in STEP 25: The target rotational speed TGT·R is set to the upper limit rotational speed for low speed operation FC·R (STEP 30).

With the above-described steps, the target rotational speed TGT·R is set to the designated rotational speed SLT·R of up to the upper limit rotational speed which corresponds to the operation mode selected by the mode changing switch 20.

Next, the processor 27 judges whether or not the value of the flag DES·FG is "0" (STEP 31). At this point, the value of the flag DES·FG is still "0" (YES in step 31), and therefore, the procedure is returned to STEP 14 in FIG. 2, and the procedure of this cycle time is completed. In STEP 14, the processor 27 designates the target rotational speed TGT·R which is determined in any one of STEPs 26 to 30 shown in FIG. 4 to the throttle driving portion 29. The throttle driving portion 29 drives the throttle motor 23 and controls the engine 1 to run at the target rotational speed TGT·R.

Accordingly, immediately after all the control levers 14 to 19 are shifted to their respective neutral positions to suspend the operation, the engine 1 is basically controlled to run at the rotational speed SLT·R designated by the throttle lever 21.

In the procedures shown by the flowchart in FIG. 4, when the operation mode selected by the mode changing switch 30 is H mode, the upper limit of the target rotational speed TGT·R is not limited to a specific value. However, in the actual operation, the upper limit of the rotational speed of the engine 1 is mechanically limited to a predetermined value (e.g., 2350 rpm) by unillustrated throttle stopper provided to the engine 1.

The above-described procedures in each cycle time is repeated until the first counter Ta is equal to or larger than the first delay time T1 (Ta≧T1: YES in STEP 9 in FIG. 2), that is, until the elapsed time from the point where all the control levers 14 to 19 are shifted to their respective neutral positions reaches the first delay time T1. After the elapsed time reaches the first delay time T1 and the first counter Ta is equal to or larger than the first delay time T1 (Ta≧T1: YES in STEP 9), the processor 29 compares the DECEL rotational speed DES·R (1050 rpm) and the designated rotational speed SLT·R. In the case of SLT·R≧DES·R (NO in STEP 12), the target rotational speed TGT·R is set to the DECEL rotational speed DES·R (STEP 12B). In the case of SLT·R<DES·R (YES in STEP 12), the target rotational speed TGT·R is set to the designated rotational speed SLT·R (STEP 12A). In the normal operation, generally, the designated rotational speed SLT·R is set to be higher than the DECEL rotational speed DES·R.

After that, the processor 27 sets the value of the flag DES·FG to "1" (STEP 13), and then, designates the target rotational speed TGT·R (=DES·R) to the throttle driving portion 29 in STEP 14. Upon the completion of this procedure, the cycle time of this time is completed. In the next cycle time and afterward, the value of the flag DES·FG is not equal to 0 in STEP 6 (DES·FG≠0: NO in STEP 6), the procedures in STEPs 7 to 9 are omitted, and the procedures in STEPs 12 to 14 are conducted.

Accordingly, in this controlling device, when the designated rotational speed SLT·R is equal to or higher than the DECEL rotational speed DES·R, the engine 1 is automatically controlled and maintained to run at the DECEL rotational speed DES·R after the elapse of the first delay time T1 from the point where all the control levers 14 to 19 are shifted to their respective neutral positions. This allows the engine 1 to run at a reduced fuel.

Figure 5:
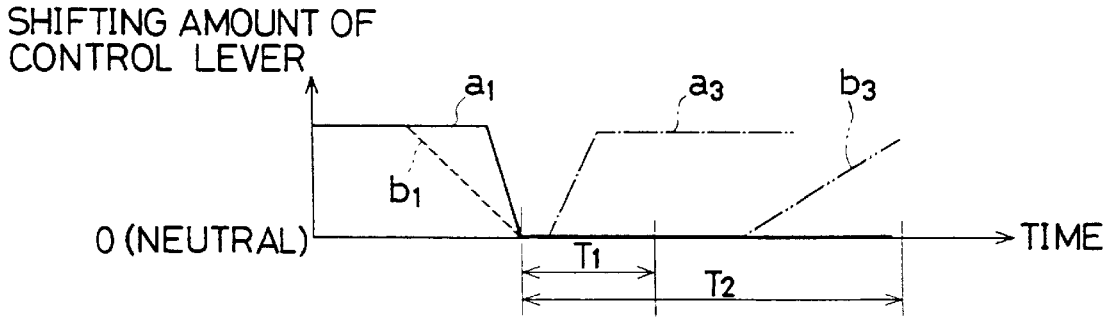
FIG. 5 is a diagram illustrating an operation of the hydraulic working machine shown in FIG. 1.

More specifically, when all the control levers 14 to 19 are shifted and maintained in their respective neutral positions to suspend the operation, generally, the last control lever is shifted from its working position to its neutral position at relatively high speed (LVR·SP≧$S_1$), for example, as shown by a solid line a1 in FIG. 5. In this case, as shown by a solid line a2 in FIG. 6, if the designated rotational speed SLT·R is higher than the DECEL rotational speed DES·R (in the normal operation, the engine runs under this state), the rotational speed of the engine 1 is automatically decreased from the designated rotational speed SLT·R (the upper limit rotational speed corresponding to each operation mode when the designated rotational speed SLT·R is higher than this upper limit rotational speed) to the DECEL rotational speed DES·R, and this operation state is maintained.

The above-described steps are conducted in the usual case where all the control levers 14 to 19 are shifted to their respective neutral position and the last control lever is quickly shifted to its neutral position to suspend the operation. However, there may be a case where the last control lever is shifted to its neutral position at a speed lower than the predetermined speed $S_1$ even when the operation is suspended (NO in STEP 7 in FIG. 2).

In this case, the processor 27 increases the value of the second counter Tb for time measurement by "1" (STEP 10). As well as the first counter Ta, the value of the second counter Tb is an indicator of elapsed time from the point where all the control levers 14 to 19 are shifted to their respective neutral positions, and is increased by "1" in STEP 10 in each cycle time as far as the control levers 14 to 19 are maintained in their neutral positions.

After the value of the second counter Tb is increased in the above-described manner, the processor 27 judges whether or not the value of the second counter Tb is equal to or larger than the second delay time T2 (STEP 11). The second delay time T2 is a delay time for low shifting speed determined in the case of LVR·SP<$S_1$ (NO in STEP 7), that is, the last control lever among the shifted control levers 14 to 19 is shifted to its neutral position at the speed lower than the predetermined speed $S_1$. For the below-described reason, the second delay time T2 is set to relatively longer time than the first delay time T1 (e.g., 20 seconds).

Thereafter, the same procedures as those conducted in the case of suspending the normal operation (that is, the case where the time is measured by the first counter Ta) are repeated. More specifically, , in the case where the elapsed time measured by the second counter Tb is shorter than the second delay time T2 (NO in STEP 11), the engine 1 is basically controlled to run at the designated rotational speed SLT·R through the procedures shown in FIG. 4. In the case where the elapsed time indicated by the second counter Tb is equal to or longer than the second delay time T2 (YES in STEP 11), the engine 1 is controlled to run at the DECEL rotational speed DES·R via the procedure in Step 12. In the case of SLT·R<DES·R (YES in STEP 12), the engine 1 is controlled to run at the designated rotational speed SLT·R even after the elapse of the second delay time T2.

Figure 6:
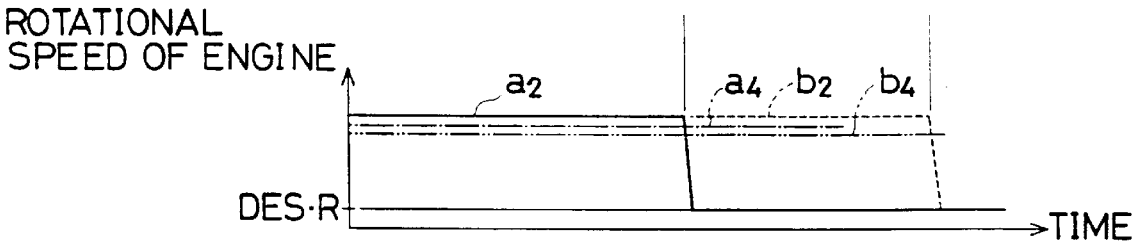
FIG. 6 is a diagram illustrating an operation of the hydraulic working machine shown in FIG. 1.

More specifically, when all the control levers 14 to 19 are shifted to their respective neutral positions to suspend the operation in the state that the designated rotational speed SLT·R is set to be higher than the DECEL rotational speed DES·R by the throttle lever 21 (that is, in the normal operation state), as shown by a broken line b1 in FIG. 5, for example, the last control lever is shifted from its working position to its neutral position at relatively low speed (LVR·SR<$S_1$) and is maintained thereto, as shown by a broken line b2 in FIG. 6, the rotational speed of the engine 1 is automatically decreased from the SLT·R (or the upper limit rotational speed corresponding to each operation mode when the designated rotational speed SLT·R is higher than this upper limit rotational speed) to the DECEL rotational speed DES·R after the elapse of the second delay time T2 which is longer than the first delay time T1 from the point where the last control lever is shifted to its neutral position, and this operation state is maintained.

As described above, when all the control levers 14 to 19 are shifted to their respective neutral positions to suspend the operation, the rotational speed of the engine 1 is automatically decreased to the DECEL rotational speed DES·R after the elapse of the first delay time T or the second delay time T2 from the point where the last control lever is shifted to its neutral position.

Next, description will be made for a case where all the control levers 14 to 19 are temporarily shifted to their respective neutral positions during the operation for the purpose other than suspending the operation.

In this case, immediately after all the control levers 14 to 19 are shifted to their respective neutral positions, the same procedures as those conducted in the case of suspending the operation are repeated. After that, the time is measured by the first counter Ta in STEP 8 or the second counter Tb in STEP 10 respectively in each cycle time.

In the case where the shifting speed LVR·SP of the last control lever shifted to its neutral position is a high shifting speed equal to or higher than the predetermined speed $S_1$, the first delay time T1 is adopted. When the control levers are shifted to their respective neutral positions for the purpose other than suspending of the operation, usually, one of the control levers 14 to 19 is shifted from its neutral position to its working position before the elapse of the first delay time T1, as shown by a dashed line a3 in FIG. 5.

When one of the control levers 14 to 19 is shifted before the elapse of the first delay time T1, the result of judgment in STEP 2 in this cycle time is NO. Accordingly, the processor 27 starts the procedures shown in FIG. 3.

First, the processor 27 resets the value of the flag LVR·FC to "0" (STEP 15), and also resets the value of the first counter Ta and the second counter Tb for time measurement (STEP 16). Then, the processor 27 judges whether or not the value of the flag DES·FG is "0" (STEP 17). In this case, as described above, one of the control levers 14 to 19 is shifted before the elapse of the first delay time T1, the engine 1 is still not controlled to run at the DECEL rotational speed DES·R (or the designated rotational speed SLT·R in the case of SLT·R<DES·R). Therefore, the value of the flag DES·FG is 0 (YES in STEP 17).

As a result, the processor 27 conducts the procedures of STEPs 22 to 31 shown in FIG. 4, and then, conducts the procedure of STEP 14 shown in FIG. 2. With these steps, the engine 1 is continuously controlled to run at the designated rotational speed SLT·R designated by the throttle lever 21 (or the upper limit rotational speed corresponding to each operation mode when the designated rotational speed SLT·R is higher than this upper limit rotational speed.).

On the other hand, when the operation is conducted at the low speed, there is a case where all the control levers 14 to 19 are maintained in their respective neutral positions for the time equal to or longer than the first delay time T1. In such a case, usually, the shifting speed LVR·SP of the last control lever shifted to its neutral position is relatively low as shown by a broken line b1 in FIG. 5, which is lower than the predetermined speed $S_1$. Accordingly, the time is measured by the second counter Tb. The second delay time T2 corresponding to the second counter Tb is set to be sufficiently longer than the first delay time T1. Accordingly, even in the low speed operation, one of the control levers 14 to 19 is shifted from its neutral position within the second delay time T2, for example, as shown by a chain double-dashed line in FIG. 5.

As described above, when one of the control levers 14 to 19 is shifted from its neutral position before the elapse of the second delay time T2, the result of judgment in STEP 2 in this cycle time is NO. Accordingly, the processor 27 starts the procedures shown in FIG. 3. Then, the processor 27 repeats the same procedure as that conducted in the case where one of the control levers 14 to 19 is shifted within the first delay time T1.

The engine 1 is continuously controlled to run at the designated rotational speed SLT·R designated by the throttle lever 21 (or the upper limit rotational speed corresponding to each operation mode when the designated rotational speed SLT·R is higher than the upper limit rotational speed).

With these steps, even when all the control levers 14 to 19 are temporarily shifted to their respective neutral positions by accident for the purpose other than suspending the operation, the rotational speed of the engine 1 is never decreased to the DECEL rotational speed DES·R against the operator's intention.

Next, description will be made for a case where the engine 1 is controlled to run at the DECEL rotational speed DES·R to suspend the operation, and one of the control levers 14 to 19 is shifted from its neutral position to restart the operation.

When one of the control levers 14 to 19 is shifted from its neutral position to restart the operation, the result of judgment in STEP 2 in this cycle time is NO. Accordingly, the processor 27 starts the procedures shown in FIG. 3.

Thereafter, the processor 27 resets the flag LVR·FG, the first counter Ta, and the second counter Tb (STEPs 15 and 16), and then judges whether or not the value of flag DES·SG is "0". In the case where the engine 1 is controlled to run at the DECEL rotational speed DES·R (or the designated rotational speed SLT·R in the case of SLT·R<DES·R), the value of the flag DES·FG is 1 (NO in STEP 17). Therefore, the processor 27 obtains the present shifting amount LVR·S of each of the control levers 14 to 19 based on the signals sent from each of the control levers 14 to 19 (STEP 18). At the same time, the processor 27 obtains a variation ΔLVR·S of the shifting amount of each of control levers 14 to 19 changed from the preceding cycle time. Then, the processor 27 judges whether or not the variation ΔLVR·S is "0" or less, in other words, whether or not all the control levers 14 to 19 are now being shifted toward their respective neutral positions (STEP 20).

When the operation is restarted, one of the control levers 14 to 19 is shifted in such a direction that the value of the variation ΔLVR·S increases, that is, the control lever is shifted in the direction from its neutral position to its maximum working position. Accordingly the result of judgment is NO in STEP 20. In this case, the processor 27, obtains a rotational speed RTN·R for restoring the rotational speed of the engine 1 from the DECEL rotational speed DES·S to the rotational speed for the normal operation (STEP 21) using the following Equation (I):

$$RTN \cdot R = \frac{\max(LVR \cdot S)}{LVR \cdot SM} \times (H \cdot R - DES \cdot R) + DES \cdot R \tag{1}$$

where "max (LVR·S)" denotes the maximum value of the shifting amount of each of the control levers 14 to 19 obtained in STEP 18, "LVR·SM" denotes the predetermined allowable maximum shifting amount corresponding to the maximum value of the shifting amount LVR·S, "H·R" denotes the maximum upper limit rotational speed of the engine 1 (e.g., 2350 rpm, this value is equal to the upper limit rotational speed of the engine 1 in the H mode operation).

Thus-obtained designated restoring rotational speed RTN·R corresponds to the present shifting amount of the control lever which is most greatly shifted in restarting the operation. For example, if the shifting amount of the control lever which is most greatly shifted is the half of the allowable maximum shifting amount LVR·SM, the designated restoring rotational speed RTN·R is at an intermediate value between the maximum upper limit rotational speed H·R and the DECEL rotational speed DES·R {H·R+DES·R)/2}. If the shifting amount of the control lever which is most greatly shifted is the allowable maximum shifting amount LVR·SM, the designated restoring rotational speed RTN·R is at the maximum upper limit rotational speed H·R.

Upon obtaining the designated restoring rotational speed RTN·R, the processor 27 performs the procedures of STEPs 22 to 30 shown in FIG. 4. Then, as described above, the processor 27 sets the target rotational speed TGT·R of the engine 1 to the rotational speed SLT·R designated by the throttle lever 21 (or the upper limit rotational speed when the SLT·R is larger than the upper limit rotational speed corresponding to each operation mode).

After that, the processor 27 judges whether or not the value of the flag DES·FG is "0" (STEP 31). Immediately after the operation is restarted, the value of the flag DES·FG is "1". Therefore, the processor 27 judges whether or not the target rotational speed TGT·R set in the STEPs 22 to 30 is equal to or higher than that of the designated restoring rotational speed RTN·R (STEP 32). In the case of TGT·R≧RTN·R (YES in STEP 32), the processor 27 sets the target rotational speed TGT·R to the designated restoring rotational speed RTN·R (STEP 33). In the case of TGT·R<RTN·R (NO in STEP 32), the processor 27 keeps the value of the target rotational speed TGT·R as it is, and resets the value of the flag DES·FG to "0" (STEP 34). After that, the processor 27 designates the target rotational speed TGT·R to the throttle driving portion 29 in STEP 14, and this cycle time is completed. In this case, when the value of the flag DES·FG is reset to "0" in STEP 34, the procedures of STEPs 32 and 33 are not conducted, because the result of judgment in STEP 31 is YES in the next cycle time and afterward.

Figure 7:
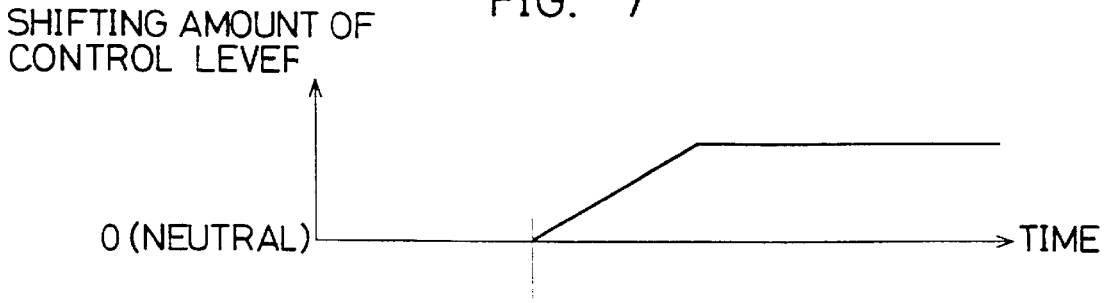
FIG. 7 is a diagram illustrating an operation of the hydraulic working machine shown in FIG. 1.
Figure 8:
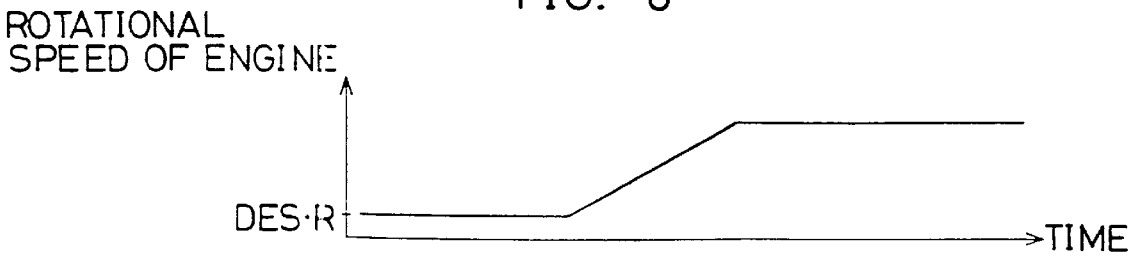
FIG. 8 is a diagram illustrating an operation of the hydraulic working machine shown in FIG. 1.

According to the procedures conducted in each cycle time, in restarting the operation, in the case where one of the control levers 14 to 19 is gradually shifted from its neutral position with increasing the shifting amount thereof as shown in FIG. 7, the target rotational speed TGT·R is set to the designated restoring rotational speed RTN·N until the designated restoring rotational speed RTN·R reaches the designated rotational speed SLT·R (or the upper limit rotational speed corresponding to each operation mode when the SLT·R is larger than this upper limit rotational speed) (YES in STEP 32). Accordingly, as shown in FIG. 8, the engine 1 is controlled to run at the rotational speed which is increased from the DECEL rotational speed DES·R in accordance with an increase in the shifting amount of the control lever. When the designated restoring rotational speed RTN·R becomes equal to or higher than the upper limit rotational speed corresponding to the designated rotational speed SLT·R designated by the throttle lever 21 or the upper limit rotational speed corresponding to each operation mode, the target rotational speed TGT·R is set to the designated rotational speed SLT·R or the upper limit rotational speed corresponding to each operation mode. In this way, the engine 1 is controlled to run at the rotational speed for the normal operation.

Accordingly, in this embodiment, when the rotational speed of the engine 1 is restored from the DECEL rotational speed DES·R to the rotational speed for the normal operation, such as the rotational speed SLT·R designated by the throttle lever 21, to restart the operation, the rotational speed of the engine 1 is increased from the DECEL rotational speed DES·R to the rotational speed for the normal operation in accordance with an increase in the shifting amount of the shifted control lever to restart the operation. With this construction, even if the rotational speed of the engine 1 is rapidly increased although the operator mildly shifts one of the control levers 14 to 19, the amount of oil fed from the hydraulic pumps 2 and 3 will not rapidly increase and the actuation of the actuators 6 to 11 will not rapidly change against the operator's intention. Accordingly, the engine 1 can be smoothly restored to its normal operation mode in accordance with the operator's intention.

In restoring the engine 1 to its normal operation mode, when all the control levers shifted from their respective neutral positions are again shifted to the neutral positions before the designated restoring rotational speed RTN·R obtained in STEP 21 is restored to the designated rotational speed SLT·R or the upper limit rotational speed corresponding to each operation mode, the result of judgment in STEP 20 in this cycle time is YES. In such a case, it is recognized that the operator intends to suspend the operation or there is no need for the engine 1 to run at the speed higher than the present rotational speed even though the operator intends to continue the operation. Accordingly, the processor 27 omits the procedure of STEP 21 for newly obtaining the designated restoring rotational speed RTN·R, and sets the target rotational speed TGT·R to the previously obtained designated restoring rotational speed RTN·R via STEP 33 in FIG. 4. As a result, the engine 1 is maintained to run at the present rotational speed. In other words, the engine 1 is controlled to run at the rotational speed adequate for the operation without being increased to excessively high value.

After that, when all the control levers 14 to 19 are shifted to their respective neutral positions to suspend the operation again, as described above, the time is measured by the first counter Ta or the second counter Tb. Then, the engine 1 is controlled to run at the DECEL rotational speed DES·R.

As described above, in the hydraulic working machine according to the embodiments of the present invention, the engine 1 can be accurately and automatically controlled to run at the rotational speed required by the operator by shifting the control levers 14 to 19.

In the above embodiments, a hydraulic working machine has been described by way of a hydraulic excavator as an example. However, it is obvious that the present invention is also applicable to cranes, for example.

INDUSTRIAL APPLICABILITY

According to the present invention, when the operation is suspended, the rotational speed of the engine is automatically and accurately changed from the designated rotational speed to the low rotational speed to save the fuel consumption without requiring any specific manipulation by the operator. In addition, it is avoidable that during the operation, the rotational speed of the engine comes into the low rotational speed against the operator's intention.

Furthermore, when the operation is restarted in the state that the engine is controlled to run at a low rotational speed in the suspension of operation, the rotational speed of the engine can be smoothly restored to the designated rotational speed.

What is claimed is:

1. A controlling device for controlling the rotational speed of an engine of a hydraulic working machine provided with:

a hydraulic pump driven by an engine; a plurality of actuators operated by oil supplied under pressure from the hydraulic pump; a plurality of actuator operating members for operating the plurality of actuators respectively; and rotational speed designating means for designating a rotational speed of the engine, the controlling device comprising:

delay time setting means for setting a delay time in accordance with a shifting speed of at least one of the plurality of actuator operating members to a neutral position thereof when all the actuator operating members are shifted to their respective neutral positions when the engine is at a rotational speed designated by the rotational speed designating means; and rotational speed controlling means for measuring an elapsed time while controlling the engine to run at the designated rotational speed when all the actuator operating members are shifted to their respective neutral positions, and controlling the engine to run at a predetermined low rotational speed to save fuel in a case that the elapsed time reaches the set delay time and all the actuator operating members are maintained in the neutral positions whereas resetting the measurement of elapsed time and controlling the engine to run at the designated rotational speed in a case that at least one of the actuator operating members is shifted from the neutral position to a working position before the elapsed time reaches the delay time, wherein the delay time setting means sets a longer time in a case of low shifting speed when the shifting speed is lower than a predetermined value than in a case of high shifting speed when the shifting speed is higher than the predetermined value.

2. A controlling device for controlling the rotational speed of an engine of a hydraulic working machine according to claim 1, wherein the delay time setting means sets a delay time in accordance with a shifting speed of an actuator operating member which is lastly shifted to its neutral position among the plurality of actuator operating members.

3. A controlling device for controlling the rotational speed of an engine of a hydraulic working machine according to claim 1 or 2, wherein the rotational speed controlling means increases the rotational speed of the engine from the low rotational speed to the designated rotational speed in accordance with an increase in the shifting amount of the actuator operating member when at least one of the actuator operating members is shifted from its neutral position to its maximum working position after the engine is controlled to run at the low rotational speed, and maintains the designated rotational speed after the rotational speed of the engine reaches the designated rotational speed.

4. A controlling device for controlling the rotational speed of an engine of a hydraulic working machine according to claim 3, wherein the rotational speed controlling means increases the rotational speed of the engine in accordance with an increase in the shifting amount of an actuator operating member which is the most shifted among the shifted operating members when a plurality of actuator operating members are shifted from their respective neutral positions to their maximum working position.

5. A controlling device for controlling the rotational speed of an engine of a hydraulic working machine according to claim 3, wherein the rotational speed controlling means stops the increasing of rotational speed of the engine and maintains the present rotational speed when all the shifted actuator operating members are returned to their respective neutral positions while the rotational speed of the engine is being increased.

6. A controlling device for controlling the rotational speed of an engine of a hydraulic working machine according to claim 5, wherein, in the case that all the shifted actuator operating members are returned to their respective neutral positions and maintained thereto while the rotational speed of the engine is being increased, the rotational speed controlling means controls the engine to run at the low rotational speed after the elapsed time reaches a delay time which is set in accordance with a shifting speed of at least one of the shifted actuator operating members returned to its neutral position, and the rotational speed controlling means increases the rotational speed of the engine to the designated rotational speed in accordance with an increase in the shifting amount of the actuator operating member when at least one of the actuator operating members is shifted from its neutral position to its maximum working position before the elapsed time reaches the delay time.

* * * * *